US006665989B2

(12) United States Patent
Bennett

(10) Patent No.: US 6,665,989 B2
(45) Date of Patent: Dec. 23, 2003

(54) ENTRYWAY SYSTEM WITH LEAK MANAGING CORNER PADS

(75) Inventor: Joel Bennett, Greensboro, NC (US)

(73) Assignee: Endura Products, Inc., Greensboro, NC (US)

( * ) Notice: Subject to any disclaimer, the term of this patent is extended or adjusted under 35 U.S.C. 154(b) by 0 days.

(21) Appl. No.: 09/963,739

(22) Filed: Sep. 25, 2001

(65) Prior Publication Data

US 2002/0035810 A1 Mar. 28, 2002

Related U.S. Application Data

(60) Provisional application No. 60/235,061, filed on Sep. 25, 2000.

(51) Int. Cl.[7] ..... E04B 2/00

(52) U.S. Cl. ..... 52/287.1; 52/198; 52/209; 52/211; 49/471; 49/476.1

(58) Field of Search ..... 52/97, 656.4, 207.1, 52/211, 209, 198, 204.51; 49/476.1, 477.1, 479.1, 463.1, 468, 467, 471

(56) References Cited

U.S. PATENT DOCUMENTS 4,525,953 A * 7/1985 Stutzman ..... 49/488
4,831,779 A * 5/1989 Kehrli et al. ..... 49/471
5,067,279 A * 11/1991 Hagemeyer ..... 49/471
5,136,814 A * 8/1992 Headrick ..... 49/468
5,426,894 A * 6/1995 Headrick ..... 49/468
5,588,266 A * 12/1996 Headrick ..... 52/204.1
5,784,834 A * 7/1998 Stutzman ..... 49/475.1
5,943,825 A * 8/1999 Procton et al. ..... 49/469
5,974,748 A * 11/1999 Sciuga et al. ..... 52/287.1
6,052,949 A * 4/2000 Procton et al. ..... 49/506
6,308,475 B1 * 10/2001 Crish, II et al. ..... 52/204.597
6,360,489 B1 * 3/2002 Burge et al. ..... 49/496.1

* cited by examiner

*Primary Examiner*—Carl D. Friedman
*Assistant Examiner*—Yvonne M. Horton
(74) *Attorney, Agent, or Firm*—Womble Carlyle Sandridge & Rice, PLLC

(57) ABSTRACT

An improved corner pad for sealing the bottom corner of a closed door has a sloped upper surface that forms a reservoir between the closed door and the jamb. Rainwater that is blown up the weather strip by wind is collected in the reservoir until the wind subsides, whereupon the water simply drains out. As a result, leakage into a dwelling at the bottom corner of the entryway is managed and contained.

6 Claims, 1 Drawing Sheet

ENTRYWAY SYSTEM WITH LEAK MANAGING CORNER PADS

REFERENCE TO RELATED APPLICATION

The benefit of the filing date of U.S. provisional patent application serial No. 60/235,061 filed on Sep. 25, 2000 is hereby claimed.

TECHNICAL FIELD

This invention relates generally to entryway systems and more specifically to techniques for sealing entryways against leaks, particularly during a blowing rainstorm.

BACKGROUND OF THE INVENTION

Entryway systems used in building construction generally include a pair of vertically extending door jambs and a head jamb that frame the entryway and receive a hinged door. An elongated threshold assembly is attached at its ends to the bottoms of the door jambs and spans the threshold of the entryway. Many modern threshold assemblies include an extruded aluminum frame having an upwardly open channel from which a sill slopes outwardly and downwardly. A threshold cap, which may be made of plastic or wood, is disposed in the upwardly open channel and underlies a closed door mounted in the entryway. The threshold cap may be vertically adjustable to engage and form a seal with a flexible sweep attached to the bottom of the door. A flexible rubber or foam weather strip extends around the stop of the jamb and is captured and compressed between the stop and the outside face of the door when the door is closed to form a seal around the periphery of the door.

One common problem with traditional and modern entryway systems is the leaking of water into a building structure at the bottom corners of the closed door of the entryway. Entryways are especially susceptible to such leakage in a blowing rainstorm because, under such conditions, water tends to collect on the sill of the threshold assembly and puddles in the region adjacent the bottom corners of the door. This puddled rainwater, then, can be forced between the door, threshold, and jamb under the influence of air pressure created by the wind.

Manufacturers of entryway systems have attempted to address leakage at the bottom corners of a closed door in a number of ways, including placing a rectangular flexible or compressible corner pad on the bottom of the jamb where the jamb meets the threshold cap. The theory is that the corner pad will become captured and compressed between the door and jamb when the door is closed to fill the space between the door and the jamb at the bottom corner of the door, thus sealing against leakage of water at this location. A problem with these traditional rectangular corner pads is that leakage can still occur at the bottom corners of a closed door under conditions of blowing rainstorms. Under such conditions, rainwater tends to collect on the sill and puddle at the bottom corners of the entryway. In addition, the wind in a blowing rainstorm generates air pressure that is greater than the pressure within the dwelling on the other side of the door and that rises in proportion to the strength of the blowing wind. It has been discovered that, under such conditions, leakage can occur at the bottom corners of the door regardless of the integrity of the seal created between the weather strip and the door and between the door and the corner pad. Observation and experimentation has demonstrated that such leakage occurs as a result of weather strip wicking and not because of a poor seal between the weather strip and the door and the corner pad and the door. Specifically, when the door is shut against the weather strip, the weather strip folds to create its seal and this folding also forms a capillary channel, similar to a small straw, that extends upwardly along the length of the weather strip. High external air pressure generated by blowing wind and the pressure differences between the outside and inside of a building pushes rainwater up into the capillary channel in the weather strip. As the external air pressure increases relative to the internal air pressure within the building, water is forced higher into the capillary channel, eventually rising over the top of the corner pad and leaking into the building. It is now clear, therefore, that traditional rectangular corner pads have been a misguided and incomplete attempt to address the problem of leakage at the lower corners of a closed door.

Thus, there exist a need for an improved method and apparatus for addressing leakage at the bottom corners of a closed door particularly in conditions of blowing rain. It is to the provision of such a method and apparatus that the present invention is primarily directed.

SUMMARY OF THE INVENTION

Briefly described, the present invention, in one preferred embodiment thereof, comprises a unique entryway corner pad. The corner pad is sized to be mounted to bottom portion of a jamb of the entryway at the intersection of the jamb and the threshold cap. Thus, the corner pad resides in the space or gap between an edge of the door and the jamb when the door is shut and is located at a bottom corner of the door. The pad is made of a compressible material such as foam or rubber and has a thickness that is greater than the width of the gap between the edge of the closed door and the jamb. It will thus be seen that the corner pad becomes captured and compressed between the door edge and the jamb when the door is shut to form a seal therebetween, in much the same way as the conventional corner pads discussed above.

Unlike conventional corner pads, however, the corner pad of the present invention has an inside edge located adjacent the inside edge of the jamb and an outside edge located at or extending behind the bottom portion of the weather strip. A top edge of the corner pad joins the inside and outside edges and, in the preferred embodiment, is sloped downwardly and outwardly from the inside edge to the outside edge of the pad. When the door is shut, the corner pad becomes compressed between the door edge and the jamb to form a seal in the usual way. Uniquely, however, the downwardly and outwardly sloped top edge of the weather strip along with the jamb face and door edge forms a narrow triangular shaped reservoir in the region immediately above the corner pad.

In a blowing rainstorm wherein water is blown up the capillary formed by the weather strip as discussed above, the rising water within the weather strip eventually reaches the top of the outside edge of the corner pad. At this point, the water begins to spill over this outside edge. However, in contrast to prior art corner pads, the water does not flow over the corner pad and through the gap into a dwelling. Instead, it begins to collect in the triangular reservoir formed by the sloped top edge of the corner pad and faces of the jamb and door edge. The collecting water, in turn, disrupts the capillary action of the weather strip, preventing water from rising any higher within the capillary formed by the weather strip. At the same time, the rain water that collects in the triangular reservoir forms a head of pressure that increases as more water collects in the reservoir. This pressure increasingly opposes the force of wind pressure tending to drive more water up the weather strip. In practice, the reservoir is sized such that the pressure developed by collecting water within the reservoir is great enough to oppose even the most fierce blowing rain so that water never spills over the back of the triangular reservoir and into a dwelling. Thus, leaking at the bottom corner of the door is prevented. When the blowing rain subsides, the water collected in the triangular reservoir simply drains out onto the sill of the threshold assembly and away from the entryway.

Thus, an improved leak managing corner pad for entryways is now provided that addresses successfully the problems and shortcomings of the prior art. The corner pad successfully prevents water leakage at the bottom corners of a closed door in a blowing rainstorm by forming a seal in the traditional way. Uniquely, however, the corner pad also functions to disrupt the capillary flow of water up the weather strip and directs this water to a reservoir to form a head of pressure that opposes the force of windblown rain. When blowing rain subsides, the collected water drains safely away. These and other features, objects, and advantages of the invention will become more apparent upon review of the detailed description set forth below taken in conjunction with the accompanying drawing figures, which are briefly described as follows.

DETAILED DESCRIPTION OF THE PREFERRED EMBODIMENTS

Figure 1:
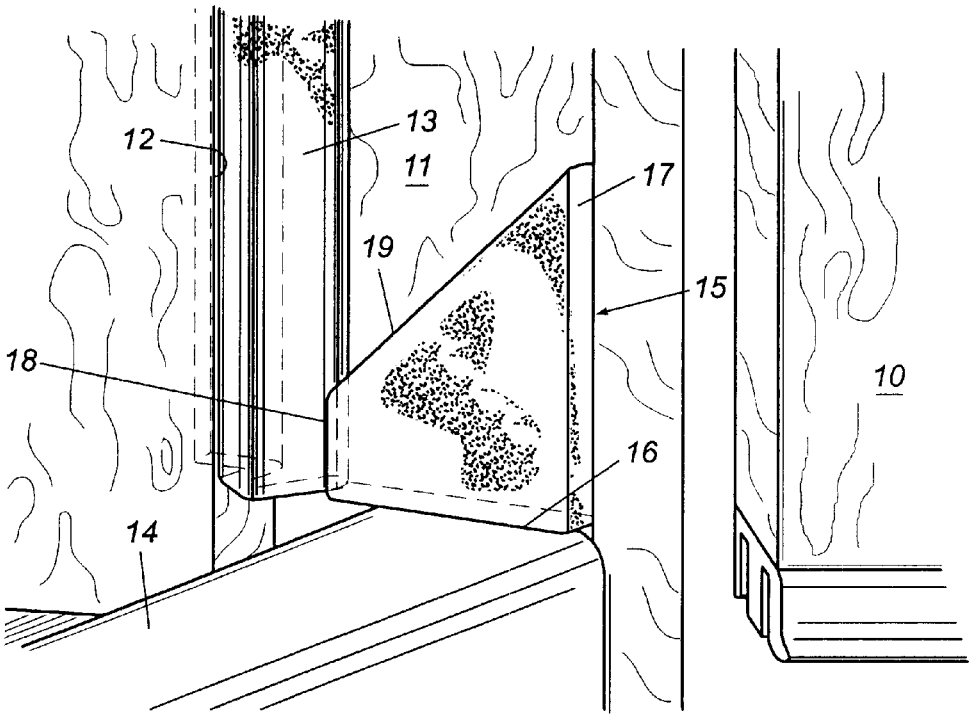
FIG. 1 is a perspective view of one of the bottom corner portions of an entryway illustrating a corner pad that embodies principles of the invention in a preferred form.

Referring now in more detail to the drawing figures, wherein like numerals refer to like parts throughout the several views, an improved corner pad configuration is disclosed for addressing leakage at the bottom corners of a closed door. FIG. 1 illustrates one bottom corner of an entryway system and shows a door 10, a vertical jamb 11 having a stop 12 and a weather strip 13 extending along the stop. A threshold assembly including a threshold cap 14 extends horizontally from the bottom of the jamb 11. The door 10 is shown in an open configuration; however, it will be understood that when the door is hinged shut, the peripheral edge of its outside face bears against and compresses the weather strip 13 to form a seal around the periphery of the door.

A flexible corner pad 15 according to the invention is attached with appropriate adhesive or the like in the lower corner of the vertical jamb where the jamb intersects the threshold cap. The corner pad 15 may be made from any appropriate collapsible or compressible material such a rubber, a foam, a cladded foam or otherwise. The thickness of the corner pad is selected to be greater than the width of the gap between the edge of the door and the jamb when the door is closed so that the corner pad becomes captured and compressed between the edge of the door 10 and the jamb 11 when the door is shut. In this way, the gap is sealed by the corner pad.

The corner pad 15 has a bottom edge 16 that rests atop the threshold cap 14. An inside edge 17 of the corner pad resides adjacent the inside edge of the jamb 11 and a relatively short outside edge 18 of the corner pad resides adjacent or extends just behind the weather strip 13. The corner pad 15 is further formed with an outwardly and downwardly sloped top edge 19 that extends from the inside edge 17 to the outside edge 18 as shown. When the door 10 is shut, the sloped top edge 19 of the corner pad in conjunction with the edge of the door and the face of the jamb forms a narrow triangular reservoir 23 (FIG. 2) in the region immediately above the corner pad at the lower corner of the entryway.

Figure 2:
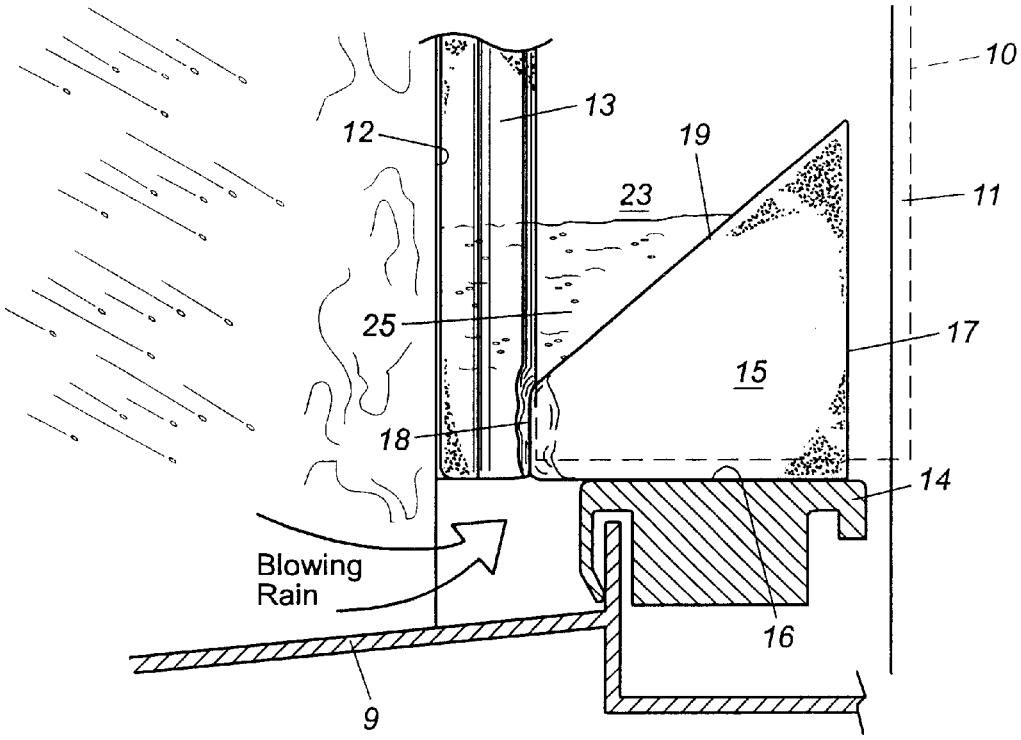
FIG. 2 is a side elevational view of the bottom corner portion of an entryway shown in FIG. 1 showing how the corner pad of this invention prevents leakage in a blowing rainstorm.

FIG. 2 is a side elevational view of the bottom corner of the entryway shown in FIG. 1 as it appears when the door is shut. The door 10 is shown in phantom lines to illustrate the corner pad 15 and its function more clearly. The weather strip 13 is seen to be compressed between the outer surface of the door and the stop 12. The door 10 is shut and the corner pad 15 is compressed between the inside edge of the door and the jamb. As discussed above, under these conditions, the sloped upper edge 19 of the corner pad forms a narrow triangular reservoir 23 between the edge of the door and the face of the jamb.

As blowing rain impinges on the outside of the entryway, the force of the wind and the difference in pressure between the outside and inside of the dwelling tends to draw or drive rainwater 25 up the weather strip as a result of capillary action as described above. When this rainwater reaches the top of the outside edge 18 of the corner pad 15, it gradually spills over into the triangular reservoir 23 as shown. Therefore, as the water is blown higher as a result of increasing wind pressure, it slowly fills the triangular reservoir 23 formed in the gap between the door edge and the jamb by the sloped upper edge 19 of the corner pad. The spilling and collection of the water into the triangular reservoir interrupts the capillary flow of water up the weather strip and also forms a increasing head of water pressure that resists further entry of water into the reservoir. Thus, when the water spills over the forward edge of the corner pad, it is gradually collected in the triangular reservoir 23 and does not spill or leak through the entryway into a dwelling. The size of the corner pad and the angle of its upper edge 19 is determined so that the rising water within the reservoir 23 will not overflow the rear edge 17 of the corner pad even under the most severe wind and rain conditions. Thus, the blown water is simply collected in the reservoir until the wind subsides, at which time it drains out of the triangular reservoir onto the sill and away from the entryway.

The present invention actively prevents the leakage of rainwater over the top of a corner pad by interrupting the capillary flow of rainwater up the weather strip and giving the water some place to go (i.e., the triangular reservoir) while at the same time containing that water so that it does not enter a dwelling. The contained water simply drains away when the wind subsides.

The invention has been described herein in terms of preferred embodiments and methodologies, it will be obvious to those of skill in the art, however, that the preferred embodiments should not be interpreted to limit the invention and that the invention may be embodied within designs and configurations other than the specific ones comprising the preferred embodiments. For instance, while the reservoir formed by the top edge of the corner pad in the preferred embodiment is triangular in shape, it might be configured to for a reservoir with a stepped or arcuate floor or any other shape if desired. Accordingly, the triangular shape of the reservoir is not an inherent limitation of the invention. Further, while a corner pad has been illustrated and discussed within the context of one pad at one corner of the entryway, a pad at each corner is desirable to prevent leakage at each location. Various other additions, deletions, and modifications might well be envisioned and made to the illustrated embodiments by persons of skill in the art without departing from the spirit and scope of the invention as set forth in the claims.

What is claimed is:

1. An entryway having a pair of vertical jambs extending upwardly from a threshold assembly, a door hingedly mounted to one of said vertical jambs for being selectively opened and shut in said entryway, and a corner pad mounted to at least one of said jambs adjacent the threshold assembly, said corner pad being formed of a compressible material and being positioned to be compressed between an edge of said door and said jamb to form a seal when said door is shut, said corner pad having a top edge configured to form a reservoir in the region above said top edge when said door is shut for collecting and holding water in a blowing rain.

2. An entryway as claimed in claim 1 and wherein said top edge of said corner pad is sloped downwardly and outwardly to form a triangular reservoir when said door is shut.

3. An entryway comprising:

a hinged door with a free edge, a hinged edge, and an outside face;

a pair of spaced jambs each having a longitudinal stop formed therealong and being spanned at their bottom ends by a threshold assembly having a sill and a threshold cap;

a weather strip mounted to each of said spaced jambs extending along said stop, said weather strip being compressed between said stop and the outside face of said door to form a seal when said door is closed;

a corner pad mounted to the bottom end of at least one of said jambs adjacent said threshold assembly;

said corner pad being formed of compressible material and having an inside edge, an outside edge, and a top edge and being configured to be compressed and form a seal between the edge of a closed door and said jamb;

said top edge of said corner pad being shaped to form a reservoir when said door is closed in the region above said corner pad for collecting water and preventing the water from leaking into a dwelling during a rainstorm.

4. An entryway as claimed in claim 3 and wherein said corner pad is made of foam.

5. An entryway as claimed in claim 3 and wherein said corner pad is made of rubber.

6. An entryway as claimed in claim 3 and wherein said top edge of said corner pad is sloped outwardly and downwardly to form a triangular reservoir.

* * * * *